US005601312A

United States Patent [19]

Funkhouser

[11] Patent Number: 5,601,312

[45] Date of Patent: Feb. 11, 1997

[54] TWO-PIECE COVER FOR BINDING A PLURALITY OF SHEETS

[75] Inventor: James D. Funkhouser, Redkey, Ind.

[73] Assignee: Pengad, Inc., Bayonne, N.J.

[21] Appl. No.: 348,299

[22] Filed: Dec. 2, 1994

[51] Int. Cl.[6] ..... B42D 1/10

[52] U.S. Cl. ..... 281/21.1; 281/29; 281/15.1

[58] Field of Search ..... 281/15.1, 21.1, 281/29, 18

[56] References Cited

U.S. PATENT DOCUMENTS

| | | | |
|---|---|---|---|
| 1,470,012 | 10/1923 | Jones et al. | 281/18 |
| 2,258,418 | 10/1941 | Macey | 281/15.1 X |
| 3,347,565 | 10/1967 | Konkel . | |
| 4,007,950 | 2/1977 | Giulie . | |
| 4,548,426 | 10/1985 | Lockhart . | |
| 4,667,983 | 5/1987 | Spolander | 281/21.1 X |
| 4,697,970 | 10/1987 | Hanson | 281/21.1 X |
| 4,702,659 | 10/1987 | Hanson | 281/29 X |
| 4,762,341 | 8/1988 | Rabuse . | |
| 4,793,758 | 12/1988 | Hanson et al. . | |
| 4,800,110 | 1/1989 | Ducorday | 281/21.1 X |
| 4,928,995 | 5/1990 | Pickering et al. | 281/29 |
| 5,025,978 | 6/1991 | Pacione . | |
| 5,052,872 | 10/1991 | Hunder et al. . | |

OTHER PUBLICATIONS

Jacobs Gardner Office Products Catalog, p. 924 1991.

*Primary Examiner*—Frances Han
*Attorney, Agent, or Firm*—Arnold D. Litt, Esq.

[57] ABSTRACT

This invention comprises a two-piece cover for binding a plurality of sheets into a booklet or brochure. The front cover panel is adapted to having printed material applied to one side by use of a standard photocopy or offset printing equipment. After application of the printed design on the front cover panel, the booklet is assembled by securing the front cover panel to the rear cover panel. The front cover panel is secured to the edge of a stack of sheets by securing means or staples. The rear cover panel contains a flap portion situated along a longitudinal side edge which is delineated from the remaining rectangular portion of the rear cover panel by two hinge-forming scorelines. The distance between the two scorelines is slightly greater than the height of the stack of sheets. The front cover panel is brought into contact with an adhesive strip having a release strip situated on the longitudinal side edge of the rear cover panel so that the bottom sheet contacts it, whereupon the release strip is removed and is adhered to the rear side of the bottom sheet of the stack. The flap portion is folded along the scorelines and brought into contact with the longitudinal side edge of the front cover panel at the securing means location. The release strip is removed, whereby the flap portion adheres to the longitudinal side edge of the front cover panel along the adhesive strip, thereby covering the securing means and resulting in the booklet.

27 Claims, 2 Drawing Sheets

TWO-PIECE COVER FOR BINDING A PLURALITY OF SHEETS

SCOPE OF THE INVENTION

This invention relates to a two-piece cover for manual binding of a plurality of sheets into a booklet or brochure.

BACKGROUND OF THE INVENTION

Many booklets or brochures are known which have one-piece construction with respect to the cover and backing portions thereof. For example, see U.S. Pat. Nos. 4,793,758 and 4,762,341. It is desirable to apply certain information and promotional text and logos onto the cover of such booklets, but the prior art one-piece construction presents major disadvantages in that such printing requires die cutting equipment and a printing press of substantial size. This results in increased printing costs, in particular, substantial cost for the plates to print the large one piece blank. Moreover, the prior art manual binding methods are comparatively complex and costly.

SUMMARY OF THE INVENTION

To overcome the above disadvantages, the present invention provides a two-piece cover for easy manual binding of a plurality of sheets into a booklet or brochure, with the front panel cover thereof of a composition which can readily receive photocopy or print material using a standard photocopy machine , and a facile method for producing such booklet or brochure.

In one of its objects, the present invention provides a two-piece cover for manual binding of a plurality of sheets into a booklet, wherein logos, promotional materials and other written information can be easily photocopied or reproduced thereon.

Another object is to provide a two-piece cover comprising a front cover panel and a rear cover panel and wherein adhesive means are provided to quickly and inexpensively incorporate and bind a plurality of loose sheets into a booklet.

Another object is to provide a two-piece cover binding method which is easy to use and inexpensive.

This and other objects of the invention will be readily apparent by reference to the following description of the invention of the preferred embodiment thereof.

The present invention utilizes a two-piece cover for binding a plurality of sheets into a booklet or brochure. The front cover panel is readily adapted to having printed material applied to at least one side thereof by use of standard photocopy or offset printing equipment, thereby permitting the user to design his own cover panel for the booklet or brochure at low cost. After application of the printed and/or graphic material on the front cover, the components of the booklet or brochure are assembled by securing the front panel to the rear cover panel using adhesive means.

In operation, the front cover is secured to the edge of a stack of sheets by securing means comprising, in a preferred embodiment, staples. The front cover panel and the rear cover panel are generally rectangular. However, the rear cover panel also contains a flap portion situated along a longitudinal side edge. The flap portion is delineated from the remaining portion of the rear cover panel by two hinge-forming scorelines, which are parallel to the longitudinal side edge, the spatial distance between the two scorelines being slightly greater than the height of the stack of sheets.

Two strips of adhesive, one situated on the rear cover panel and the other on the flap portion, are located on either side of the scorelines and are equi-distant therefrom. Each of the adhesive strips is covered by a removable release strip which when removed exposes the adhesive. The front cover panel as secured to the stack of sheets is brought into contact with the release strip situated on the longitudinal side edge of the rear cover panel so that the bottom sheet of the stack of sheets contacts it, whereupon the release strip is removed and the exposed adhesive strip adheres to the rear side of the bottom sheet of the stack.

The flap portion of the rear cover panel is then folded along the scorelines and brought into contact with the longitudinal side edge of the front cover panel at the point where the securing means is located, (in a preferred embodiment where the staples are located). The release strip is removed from the flap portion, activating the adhesive means, whereupon the flap portion adheres to the longitudinal side edge of the front cover panel along the adhesive strip, covering the securing means (the staples in the preferred embodiment) and resulting in the bound booklet or brochure.

DESCRIPTION OF THE DRAWING

The present invention will be further described with reference to the accompanying drawings.

DESCRIPTION OF THE PREFERRED EMBODIMENT

The present invention provides an improved binding cover for use in making a booklet, brochure or manuscript for purposes of presentation of a professional-looking document or report in a bound format, as well as a method for making same. The present invention also permits facile printing of logos, promotional material and other information on the front cover panel of the bound document in an easy, cost efficient manner.

Figure 1:
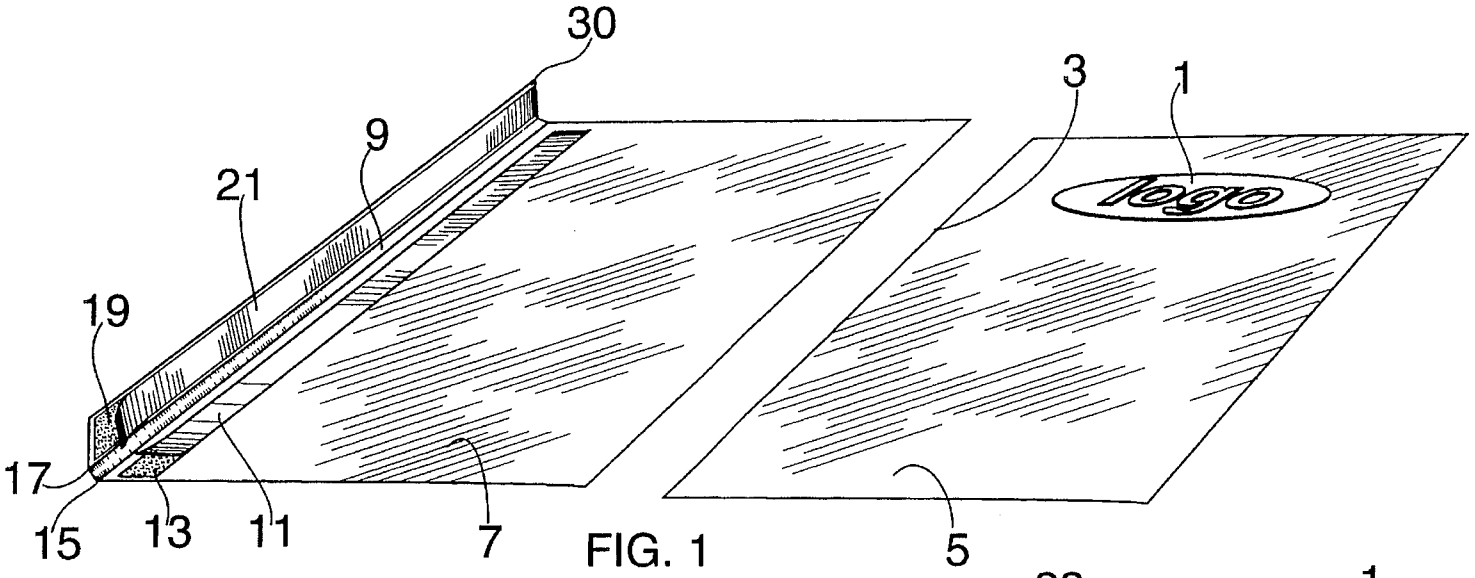
FIG. 1 is a plan view of the front and rear cover panels.

With reference to FIG. 1, front and rear cover panels, 5 and 7 respectively, are shown. The front cover panel is generally rectangular and can vary in size, with preferred dimensions being 8½ by 11 and 8½ by 14. The front cover panel contains a longitudinal side edge 3 where the securing means, to be described in more detail hereinbelow, is situated. The cover is made of a suitable material to permit photocopying of logos, promotional material and other information on its surface such as the logo, 1, depicted.

The rear cover panel 7, is of a size generally the same as the front cover panel except that it also contains a flap portion, 30, along its longitudinal side edge, 9. Two adhesive strips, 13 and 19 are covered with release strips 11 and 21 which when peeled off expose the adhesive strips, 13 and 19. The adhesive strips are situated on either side of two scorelines, 15 and 17 and equidistant therefrom. The adhesive material 13 and 19 as well as the release strips 11 and 21 are generally well known in the art such as described in U.S. Pat. Nos. 4,762,341, 4,793,758 and 5,052,872.

The composition of the front and rear cover panels comprises thin sheets of material which may have printed material readily applied thereto. For example, the front cover panel may comprise a material which is readily printed upon, by passing the same through a conventional photocopier. The composition is preferably paperboard or bristol board. Most preferably the basis weight will be 65# cover sheet stock with a target caliper preferably 0.08 to 0.1 and most preferably 0.09; and a target Sheffield smoothness of 140 to 147, preferably 145 to 147 and most preferably 147. A preferred cover stock is sold by Cross Pointe Paper Company. The 65# cover material has a smooth finish making it acceptable to laser and ink jet printers.

A preferred release strip comprises a double coated tissue with an adhesion (oz./in.) of 99 to 120, preferably 110 to 120 and most preferably 120; a tensile (lbs./in.) between 1 and 2 and most preferably 2; a thickness (mils.) between 4 and 4.5, most preferably 4.5; and a elongation (%) between 27 and 30, preferably 29 to 30 and most preferably 30. A preferred release strip covering the adhesive/release strip is sold by Spectape, Inc., Scott's Plastic Index Co. and 3-M Company, Inc. This double-coated tissue has excellent adhesion, is very thin and has excellent die-cutting properties. It has quick-stick characteristics and shear adhesion. It is very flexible and offers good conformability to irregular surfaces. This tape has a ⅛th inch extended liner for easier removal.

Figure 2:
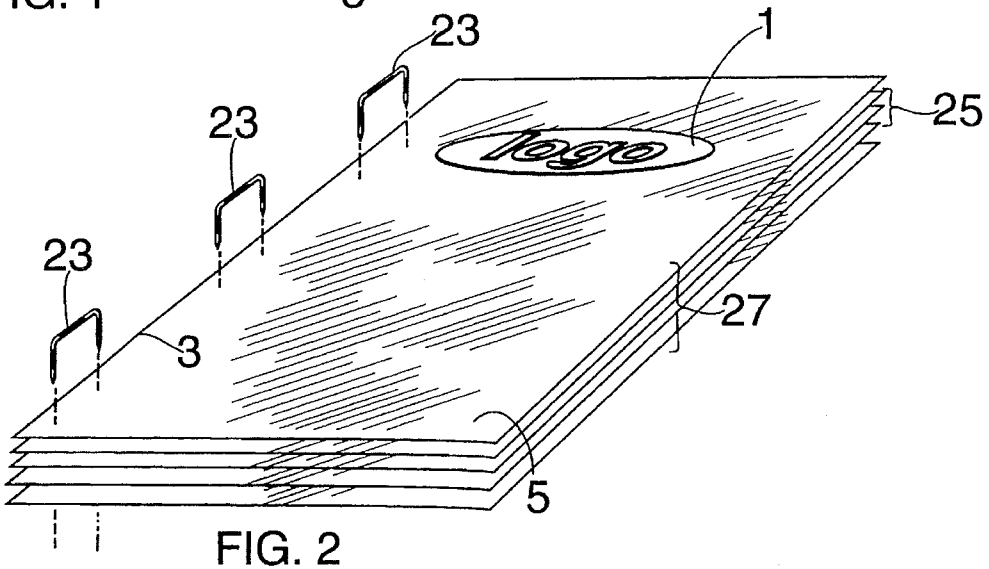
FIG. 2 is an exploded enlarged plan view of the front cover panel secured to a stack of a plurality of sheets by staples.

In FIG. 2, a plurality of sheets, 25, are secured to the front cover panel 5 by means of staples, 23, located along the longitudinal side edge of the front cover panel 3, thereby securing the front cover panel and the stack of sheets, 27. While staples are shown as one embodiment of the securing means, any other securing means well known in the art may be utilized.

Figure 3:
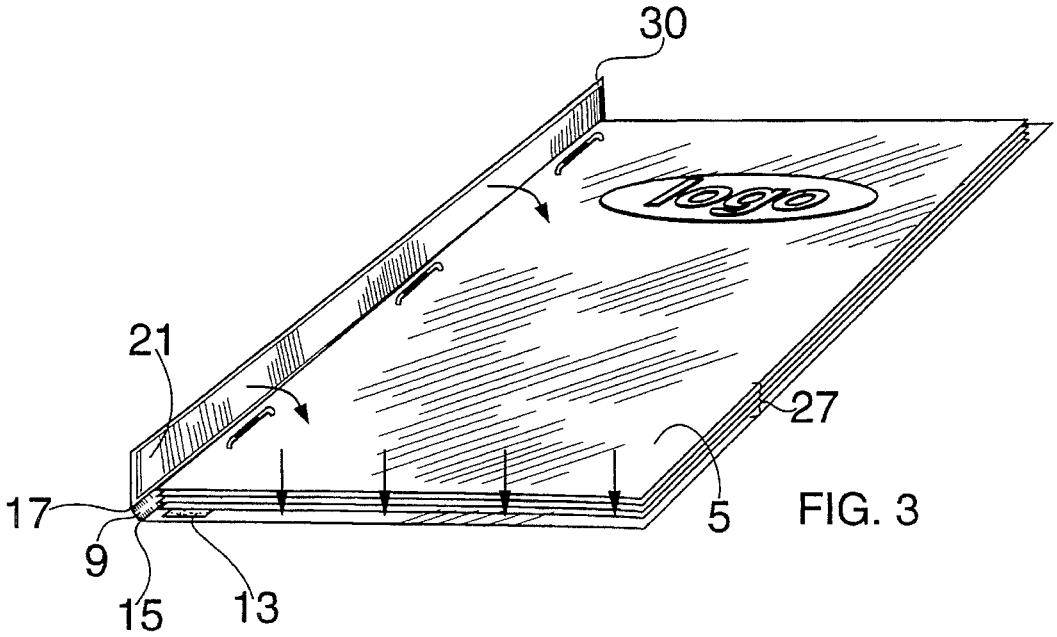
FIG. 3 is an enlarged plan view of the rear cover panel and front cover panel secured to the stack of sheets.
Figure 4:
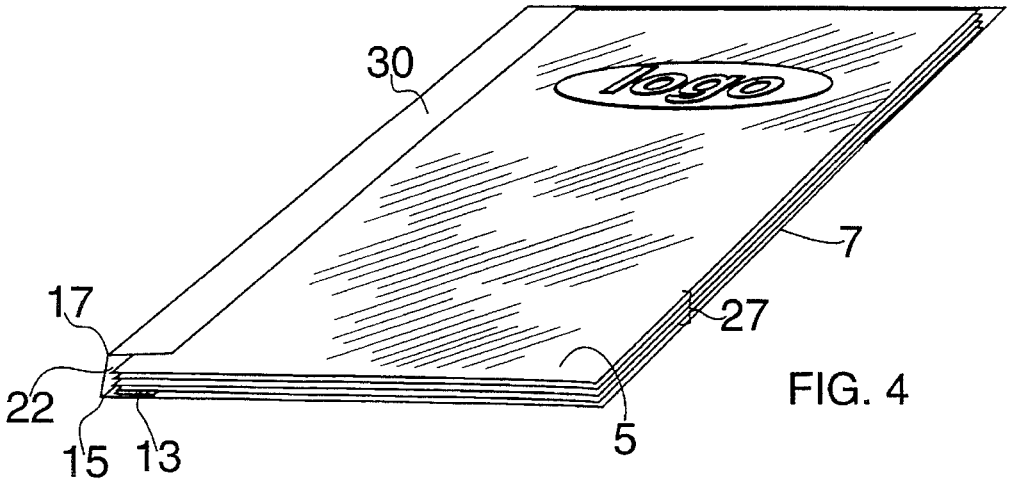
FIG. 4 is a plan view of the bound manuscript.

With reference to FIGS. 3 and 4, the front cover panel, 5, as secured to the stack of sheets by staples 23, is brought into contact with the rear cover panel to begin the process of binding the sheets into the booklet. Initially, the release strip 11 is removed from adhesive strip 13 thereby exposing the adhesive material. Simultaneously, the longitudinal side edge of the bottom sheet of the stack of sheets secured to the front cover panel is brought into contact and positioned upon the adhesive strip. The adhesive material is pressure sensitive so that application of finger pressure along the edge results in the securing of the longitudinal side edge of the stack of sheets along the entire length of the adhesive strip 13.

The flap portion, 30, of the rear cover panel contains an adhesive strip 19, (see FIG. 1) and release strip 21. The release strip is removed, exposing the adhesive material. The flap portion, 30, is then folded along the two hinge-forming scorelines, 15 and 17, over the staples and onto the longitudinal side edge of the front cover panel, whereupon finger pressure is applied along the entire length of the adhesive strip to secure the flap portion, 30, to the longitudinal side edge of the front cover panel. The final configuration of the bound manuscript is shown in FIG. 4.

Figure 5:
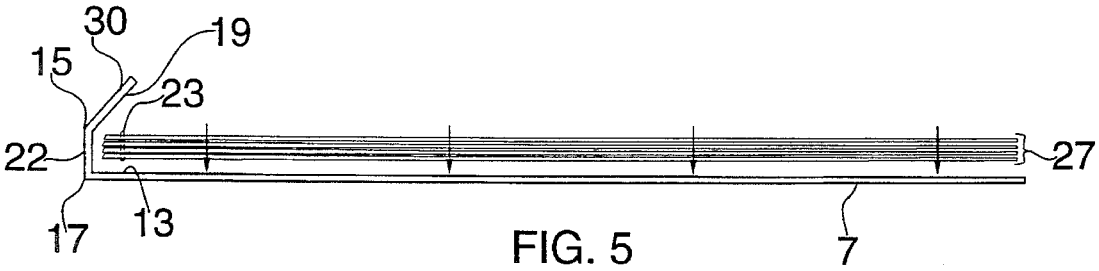
FIG. 5 is an enlarged fragmentary side view of the manuscript with the flap portion of the rear cover panel in an open configuration.
Figure 6:
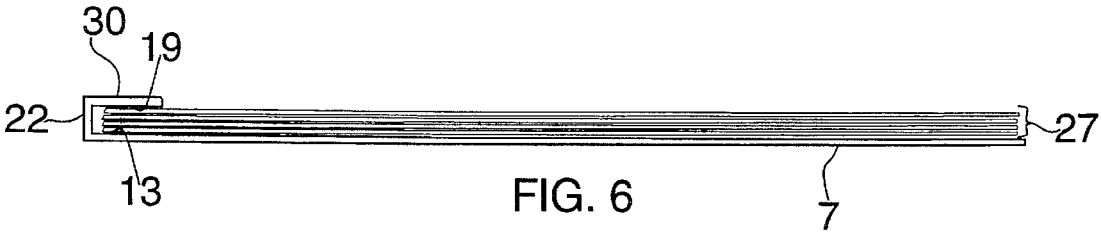
FIG. 6 is an enlarged fragmentary side view of the bound manuscript.

FIGS. 5 and 6 are enlarged side views of the booklet. FIG. 5 shows the plurality of sheets secured to the front cover panel by staples 23. The arrows show the direction the combined sheets and front cover panel 27 move as they are brought into contact with the adhesive strip 13 on the rear cover panel 7. The flap portion 30 of the rear cover panel is then folded along scorelines 15 and 17 to thereby cover the staples and to secure the flap portion onto the longitudinal side edge of the front cover panel. This results in a bound manuscript with a spine, 22, whose width is slightly greater than the height of the stack of sheets. FIG. 6 shows the final configuration of the bound manuscript.

In practice, approximately 25 sheets of 20# paper may be bound by this technique, although it can be appreciated that by increasing the spatial distance between the scorelines, or decreasing the thickness of the sheet the booklet can accommodate more sheets.

Having thus described the present invention, what is claimed is:

1. A two-piece cover for manually binding a stack of loose sheets into a booklet or brochure, comprising:

front and rear cover panels, each containing longitudinal side edges and wherein the front cover panel is readily adapted to having printed or graphic material applied to at least one side thereof by way of printing means;

the rear cover panel including a generally rectangular sheet having a flap portion extending along one longitudinal side edge thereof, a spine portion and a remaining portion, and wherein the flap portion is separated from said remaining portion of the rear cover panel by two hinge-forming scorelines situated along the spine portion and parallel to the longitudinal side edge of the rear cover panel, the spatial distance between the two scorelines being slightly greater than the height of the stack of loose sheets;

adhesive means situated along the longitudinal side edge of the rear cover panel and along the flap portion for securing the rear cover panel to the front cover panel;

the front cover panel including a generally rectangular sheet secured to the stack of loose sheets by way of securing means situated along the longitudinal side edge of the front cover panel;

wherein the rear cover panel is adapted to be secured to the front cover panel by bringing the adhesive means on the rear cover panel longitudinal side edge into contact with the longitudinal side edge of a bottom sheet of the stack of loose sheets secured to the front cover panel, so that the flap portion of the rear cover panel is positioned along the same longitudinal side edge containing the securing means of the front cover, thereby permitting the flap portion of the rear cover panel to overlap the longitudinal side edge of the front cover panel when the flap portion is folded longitudinally along the scoreline, whereby the front and rear cover panels and the stack of sheets are secured to one another by said adhesive means.

2. The cover according to claim 1, wherein the adhesive means comprises a strip of adhesive covered by a release sheet.

3. The cover according to claim 2, wherein the adhesive means comprises two parallel strips situated on either side of, and substantially equi-distant from, said scorelines of the rear cover panel.

4. The cover according to claim 3, wherein the strips are situated along the longitudinal side edge of the rear cover panel.

5. The cover according to claim 1, wherein the securing means comprises a plurality of staples which are stapled to the stack of loose sheets along the longitudinal side edge of the front cover panel.

6. The cover according to claim 1, wherein the printing means comprises photocopying means.

7. The cover according to claim 1, wherein the printing means comprises laser printer means or ink-jet printer means.

8. The cover according to claim 1, wherein the printing means comprises offset printing means.

9. A two-piece cover for manually binding a stack of loose sheets into a booklet or brochure, comprising:

front and rear cover panels, each having longitudinal side edges;

the rear cover panel including a generally rectangular sheet having a flap portion extending along one longitudinal side edge of the rear cover panel a spine portion and a remaining portion, and wherein the flap portion is separated from said remaining portion of the rear cover panel by two hinge-forming scorelines situated along the spine portion and parallel to the longitudinal side edge of the rear cover panel, the spatial distance between the two scorelines being slightly greater than the height of the stack of loose sheets;

adhesive means situated along the longitudinal side edge of the rear cover panel and along the flap portion for securing the rear cover panel to the front cover panel;

the front cover panel including a generally rectangular sheet secured to the stack of loose sheets by way of securing means situated along the longitudinal side edge of the front cover panel;

wherein the rear cover panel is adapted to be secured to the front cover panel by bringing the adhesive means on the rear cover panel longitudinal side edge into contact with the longitudinal side edge of a bottom sheet of the stack of loose sheets secured to the front cover panel, so that the flap portion of the rear cover panel is positioned along the same longitudinal side edge containing the securing means of the front cover, thereby permitting the flap portion of the rear cover panel to overlap the longitudinal side edge of the front cover panel when the flap portion is folded longitudinally along the scorelines, whereby the front and rear cover panels and the stack of loose sheets are secured to one another by the adhesive means.

10. The cover according to claim 9, wherein the adhesive means comprises a strip of adhesive covered by a release sheet.

11. The cover according to claim 10, wherein the adhesive means comprises two parallel strips situated on either side of, and substantially equi-distant from, the scorelines of the rear cover panel.

12. The cover according to claim 11, wherein the strips are situated along the longitudinal side edge of the rear cover panel.

13. The cover according to claim 9, wherein the securing means comprises a plurality of staples which are stapled to the stack of sheets along the longitudinal side edge of the front cover panel.

14. The cover according to claim 9, wherein the front and rear cover panels are readily adapted to having printed or graphic material applied to at least one side thereof by way of printing means.

15. A two-piece cover for manually binding a stack of loose sheets into a booklet or brochure, comprising:

front and rear cover panels, each having longitudinal side edges, and wherein the front cover panel is readily adapted to having printed or graphic material applied to at least one side thereof by way of printing means;

the rear cover panel including a generally rectangular sheet having a flap portion extending along one longitudinal side edge of the rear cover panel, a spine portion and a remaining portion, and wherein the flap portion is separated from said remaining portion of the rear cover panel by two hinge-forming scorelines situated along the spine portion and parallel to the longitudinal side edge of the rear cover panel, the spatial distance between the two scorelines being slightly greater than the height of the stack of loose sheets;

adhesive means situated along the longitudinal side edge of the rear cover panel and along the flap portion for securing the rear cover panel to the front cover panel, the adhesive means including two parallel strips situated on either side of, and substantially equi-distance from, the scorelines on the rear cover panel;

the front cover panel including a generally rectangular sheet secured to the stack of loose sheets by way of securing means situated along the longitudinal side edge of the front cover panel thereof;

wherein the rear cover panel is adapted to be secured to the front cover panel by bringing the adhesive means on the rear cover panel longitudinal side edge into contact with the longitudinal side edge of a bottom sheet of the stack of sheets secured to the front cover panel, so that the flap portion of the rear cover panel is positioned along the same longitudinal side edge containing the securing means of the front cover, thereby permitting the flap portion of the rear cover panel to overlap the longitudinal side edge of the front cover panel when the flap is folded longitudinally along the scorelines, whereby the front and rear cover panels and the plurality of sheets are secured to one another by the adhesive means.

16. The cover according to claim 15, wherein each of the adhesive strips is covered by a release sheet which when removed, exposes the adhesive strip.

17. The cover according to claim 16, wherein the strips are situated along the longitudinal side edge of the rear cover panel.

18. The cover according to claim 15, wherein the securing means comprises a plurality of staples which are stapled to the stack of loose sheets along the longitudinal side edge of the front cover panel.

19. The cover according to claim 15, wherein the printing means comprises photocopying means.

20. The cover according to claim 15, wherein the printing means comprises laser printer means or ink-jet printer means.

21. The cover according to claim 15, wherein the printing means comprises offset printing means.

22. A method of binding a stack of loose sheets into a manuscript, comprising the following steps:

(a) applying indicia or written material to a front cover panel of the manuscript by printing means, wherein the manuscript includes:

a front cover panel, readily adapted to having printed or graphic material applied to at least one side thereof by printing means;

a rear cover panel;

the front cover panel being generally rectangular in shape and containing a longitudinal side edge along which securing means are provided to secure the stack of loose sheets thereto;

the rear cover panel including a generally rectangular sheet with adhesive means situated along one longitudinal side edge thereof and along a flap portion extending from the longitudinal side edge of the rear cover panel, and separated from the remaining portion of the rear cover panel by a spine portion, the adhesive means being provided for securing the rear cover panel to the front cover panel;

the flap portion is separated from said remaining portion of the rear cover panel by two hinge-forming scorelines situated along the spine portion and parallel to the longitudinal side edge, the spatial distance between the two scorelines being slightly greater than the height of the stack of loose sheets to be bound; and the adhesive means including two parallel adhesive strips situated on either side of, and substantially equi-distance from, the scorelines of the rear cover panel, and wherein the adhesive means is covered by a release sheet which activates the adhesive means when it is removed therefrom;

(b) contacting a bottom surface of the front cover panel to a top sheet of the stack of loose sheets, along the longitudinal side edge of the top sheet of the stack of loose sheets, and securing the front cover panel to the plurality of loose sheets by way of securing means situated along the longitudinal side edge of the front cover panel;

(c) contacting the adhesive means on the rear cover panel longitudinal side edge with the longitudinal side edge of a bottom sheet of the stack of loose sheets secured to the front cover panel, so that the flap portion of the rear cover panel is positioned along the same longitudinal side edge containing the securing means of the front cover, thereby permitting the flap portion of the rear cover panel to overlap the longitudinal side edge of the front cover panel when the flap portion is folded longitudinally along the scorelines; and (d) securing the front and rear cover panels and the plurality of sheets to one another by the adhesive means.

23. The method according to claim 22, wherein the adhesive strips are situated along the longitudinal side edge of the rear cover panel.

24. The method according to claim 22, wherein the securing means includes a plurality of staples which are stapled to the stack of loose sheets along the longitudinal side edge of the front cover panel.

25. The method according to claim 22, wherein the printing means comprises photocopying means.

26. The method according to claim 22, wherein the printing means comprises laser printer means or ink jet printer means.

27. The method according to claim 22, wherein the printing means comprises offset printing means.

* * * * *